US007290686B2

(12) United States Patent
von Detten

(10) Patent No.: US 7,290,686 B2
(45) Date of Patent: Nov. 6, 2007

(54) CLOTHES-HANGER

(76) Inventor: Volker von Detten, 535 E. Walnut Ave., El Segundo, CA (US) 90245

( * ) Notice: Subject to any disclaimer, the term of this patent is extended or adjusted under 35 U.S.C. 154(b) by 461 days.

(21) Appl. No.: 10/844,232

(22) Filed: May 11, 2004

(65) Prior Publication Data

US 2004/0226971 A1 Nov. 18, 2004

Related U.S. Application Data

(60) Provisional application No. 60/469,867, filed on May 12, 2003.

(51) Int. Cl.
*A41D 27/22* (2006.01)

(52) U.S. Cl. ..... 223/88; 223/85; 223/92; 223/95

(58) Field of Classification Search ..... 223/85, 223/88, 91–93, 95–97
See application file for complete search history.

(56) References Cited

U.S. PATENT DOCUMENTS

| | | | | | |
|---|---|---|---|---|---|
| 2,107,026 | A | * | 2/1938 | Coney | 223/91 |
| D157,273 | S | * | 2/1950 | Lormor | D6/319 |
| 2,500,729 | A | | 3/1950 | Winnemore | |
| 2,517,211 | A | * | 8/1950 | Jones | 223/95 |
| 3,013,706 | A | | 12/1961 | Morton | |
| 3,186,609 | A | * | 6/1965 | Patch | 223/88 |
| 3,343,734 | A | | 9/1967 | Merriman | |
| 3,348,745 | A | | 10/1967 | Basile et al. | |
| 3,407,979 | A | * | 10/1968 | Patch | 223/88 |
| 3,409,191 | A | * | 11/1968 | Fuss | 223/91 |
| 3,484,029 | A | * | 12/1969 | Gaydos | 223/85 |
| 3,897,893 | A | * | 8/1975 | Lemmenes | 223/91 |
| 4,155,493 | A | | 5/1979 | Palmaer | |
| D285,264 | S | | 8/1986 | Miale | |
| 4,632,286 | A | | 12/1986 | Koyama | |
| 5,161,720 | A | * | 11/1992 | Kolton et al. | 223/85 |
| 5,562,237 | A | | 10/1996 | Saliaris | |
| 5,613,628 | A | * | 3/1997 | Burkhalter | 223/85 |
| 6,036,063 | A | * | 3/2000 | Rhyne | 223/85 |
| 6,047,867 | A | | 4/2000 | Heiber | |
| 6,105,835 | A | * | 8/2000 | Hatakeyama | 223/88 |
| 6,230,945 | B1 | | 5/2001 | Licari et al. | |
| 6,334,559 | B1 | * | 1/2002 | Armaly | 223/85 |
| 6,338,426 | B1 | * | 1/2002 | Okiyama | 223/96 |

* cited by examiner

*Primary Examiner*—Gary Welch
*Assistant Examiner*—Nathan E Durham
(74) *Attorney, Agent, or Firm*—Gene Scott Patent Law & Venture Group

(57) ABSTRACT

A clothes-hanging apparatus is made of a wire formed into an upwardly extending hanger contiguous with a downwardly extending pair of sloping shoulders, the shoulders each contiguous with one of a pair of separate collinear horizontal legs, the horizontal legs terminating in an adjacent, close-abutting relationship. A strengthening web is formed on and between critical portions of the shoulders and the legs for rigidizing the apparatus. An element is used to support or connect the legs so they may be parted or joined as desired for placement and removal of a garment.

5 Claims, 4 Drawing Sheets

CLOTHES-HANGER

RELATED APPLICATIONS

This application claims the priority date of a prior filed provisional application having Ser. No. 60/469.867 and filing date of May 12, 2003 and entitled: Clothes Hanger Allowing Draping and Removal of Garments or Slacks Efficiently in Tight Spaces.

BACKGROUND OF THE INVENTION

1. Incorporation by Reference

Applicant(s) hereby incorporate herein by reference, any and all U.S. patents and U.S. patent applications cited or referred to in this application.

2. Field of the Invention

This invention relates generally to clothes hangers and more particularly to a clothes hanger that is inexpensive to produce, has a split horizontal bar so that garments may be slipped on and off the bar by parting the legs of the bar and wherein the legs are jointly engagable for securing the garment after it is engaged with the hanger.

3. Description of Related Art

The following art defines the present state of this field:

Miale, U.S. Des. 285,264 describes a hanger design.

Jaffe, U.S. Des. 295,700 describes a clothes hanger design.

Winnemore, U.S. Pat. No. 2,500,729 describes a garment hanger comprising a pair of elongated sections disposed in intersecting relation adjacent corresponding ends thereof and pivotally connected together at said intersection, said sections thus disposed and connected providing relatively long normally downwardly directed diverging garment-supporting portions disposed below said pivotal connection, said sections above the pivotal connection providing a pair of relatively short separable loop-forming portions normally held in engagement with each other by the weight of the relatively long garment-supporting portions.

Morton, U.S. Pat. No. 3,013,706 describes a garment hanger comprising a pair of elongate, smooth, substantially straight, horizontal clamping rods, normally disposed parallel and in side-by-side relation, said rods being integral portions of a single length of smooth wire and being integrally joined at one end by a spiral spring coil of the same length of wire and which tends to hold said rods closely adjacent to each other, the maximum transverse thickness of the hanger not substantially exceeding four times the diameter of the wire whereby garments carried by such hangers, suspended from a fixed horizontal bar, may be packed closely together, each of said horizontal rods, at that end which is remote from the spring coil, having a downwardly inclined portion which merges with a short horizontal portion which, in turn, merges with an upwardly directed extension which is inclined inwardly at an acute angle to the horizontal, the two extensions being substantially parallel and closely adjacent to each other, each extension being located directly above a corresponding one of said horizontal rods, one of said extensions terminating in a downwardly open suspension hook consisting of a single thickness of the wire and which is located above the midlengths of the horizontal rods, the other of said extensions being shorter than the hooked extension and terminating at a distance below the lower part of the hook, and having its end permanently secured to the hooked extension at a point spaced from the hook, an annular slider which embraces both of said extensions and which is movable from an upper position such that it permits separation of those ends of the horizontal rods which are remote from the spring coil, so that they may receive between them the margin of a garment, and a lower clamping position where the slider holds the horizontal rods in garment-gripping position, the connection of the extensions with the horizontal rods being such as to permit the hook to be moved up out of engagement with a supporting bar without lifting the horizontal rods or necessitating the removal of a garment gripped between said horizontal rods.

Merriman, U.S. Pat. No. 3,343,734 describes a garment hanger comprising, in combination, a supporting portion, a horizontal elongated first portion extending from said supporting portion defining a first surface, a horizontal elongated equalizing bar portion having a second surface defined thereon, said equalizing bar portion including spaced end portions and a central portion disposed between said end portions, one of said end portions being unobstructed and freely accessible, and cantilever supported resilient biasing means supporting said equalizing bar portion in vertical alignment with 'respect to said horizontal elongated first portion whereby said first and second surfaces are related in an opposed relationship to hold a garment therebetween, said resilient biasing means supportingly engaging said equalizing bar portion only at said central portion and supporting said equalizing bar portion for angular movement relative to said first portion and biasing said equalizing bar portion toward said first portion for holding a garment between said first and second surfaces.

Basile et al., U.S. Pat. No. 3,348,745 describes a garment hanger comprising a single elongated metal rod round in cross section having outwardly and downwardly extending shoulder portions including lower ends thereon and an upstanding central arched portion connected therebetween, a horizontal bar extending inwardly at one end from the lower end of one of said shoulder portions and. having an upstanding portion at the other end closely spaced from the lower end of the other of said shoulder portions, said horizontal bar being substantially straight and having opposite end portions inclined downward and outwardly relative to said upstanding portion and said lower end of one of said shoulder portions, respectively, and a hook projecting upwardly from said central arched portion.

Palmaer, U.S. Pat. No. 4,155,493 describes a clothes hanger having a fixed hook member, which pivotably supports a second hook member. The second hook member can pivot to a position in which it locks the hanger on a rail, but can be released by operating handle portions provided on the hook members.

Koyama, U.S. Pat. No. 4,632,286 describes a garment hanger having a base with a hook and a trousers mount. A connector connects the base and the trousers mount in such a way that one end of the mount is open and a space for hanging and removing trousers is formed between the base and the mount. The ends of the mount are provided with elements, which engage and hold the trousers only when the hanger is tilted so as to prevent the trousers from sliding off the mount.

Saliaris, U.S. Pat. No. 5,562,237 describes a trousers hanger of the type having two integrally formed legs disposed at an acute angle which form an open end through which trousers can be easily mounted over one leg of the hanger. The other side of the hanger includes a hook end adapted to permit the hanger to be hung from a clothing rod or the like. The lower leg which accepts a pair of trousers includes a pair of spaced, linearly extending gripping bars overlying significant length portions of the lower leg and are resiliently biased in a closely spaced relationship to an upper edge of the lower ledge for engaging a pair of trousers placed between the gripping bars and lower leg in a manner which tends to hold the trousers in a slightly taunt, unwrinkled condition. The confronting inner ends of each gripping bar are spaced from one another and include an upturned edge to facilitate mounting an edge of the trousers under each gripping bar.

Heiber, U.S. Pat. No. 6,047,867 describes a garment hanger including an elongate slide member adapted to receive a garment suspended therefrom, and clamp means for holding the garment on the elongate slide member. The elongate slide member has a first end region and an opposed second end region, and is structured so as to impart a gravitational bias on the garment in the direction of the second end region. The clamp means is arranged proximate the first end region of the elongate slide member, and holds the garment on the elongate slide member in opposition to the gravitational bias imposed on the garment by the structure of the slide member. The hanger also includes support means for associating the garment hanger with a fixed support structure, such as a clothes rod.

Licari et al., U.S. Pat. No. 6,230,945 describes a "through-the-neck" garment hanger that may be fabricated with a single component. The hanger has a base portion, first and second slanted side portions, a neck portion, and a hook portion. One of the slanted side portions of the hanger has a free end that is not integrally attached to the rest of the hanger. Thus, a door may be formed between the slanted side portions whereby the hanger may be easily inserted through the neck of a garment.

Our prior art search with abstracts described above teaches: several closes hangers including a design, but fails to teach a molded wire hanger with reinforcing webs for rigidizing strength and closure means for securing a garment supporting split horizontal rod. The present invention fulfills these needs and provides further related advantages as described in the following summary.

SUMMARY OF THE INVENTION

The present invention teaches certain benefits in construction and use which give rise to the objectives described below.

A clothes-hanging apparatus is made of a wire formed into an upwardly extending hook contiguous with a downwardly extending pair of sloping shoulders, the shoulders each contiguous with one of a pair of separate collinear horizontal legs, the horizontal legs terminating in an adjacent, non-abutting relationship. A strengthening web is formed on and between critical portions of the shoulders and the legs for rigidizing the apparatus. An element may be used to support or connect the legs so they may be parted or joined as desired.

A primary objective of one embodiment of the present invention is to provide an apparatus and method of use of such apparatus that yields advantages not taught by the prior art.

Another objective is to assure that an embodiment of the invention is capable of supporting a garment when hung on a supporting rod by rigidizing portions thereof.

A further objective is to assure that an embodiment of the invention is capable of slipping a garment onto the horizontal legs by parting them.

A still further objective is to assure that an embodiment of the invention is capable of securing the legs after a garment has been placed thereon.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 6:
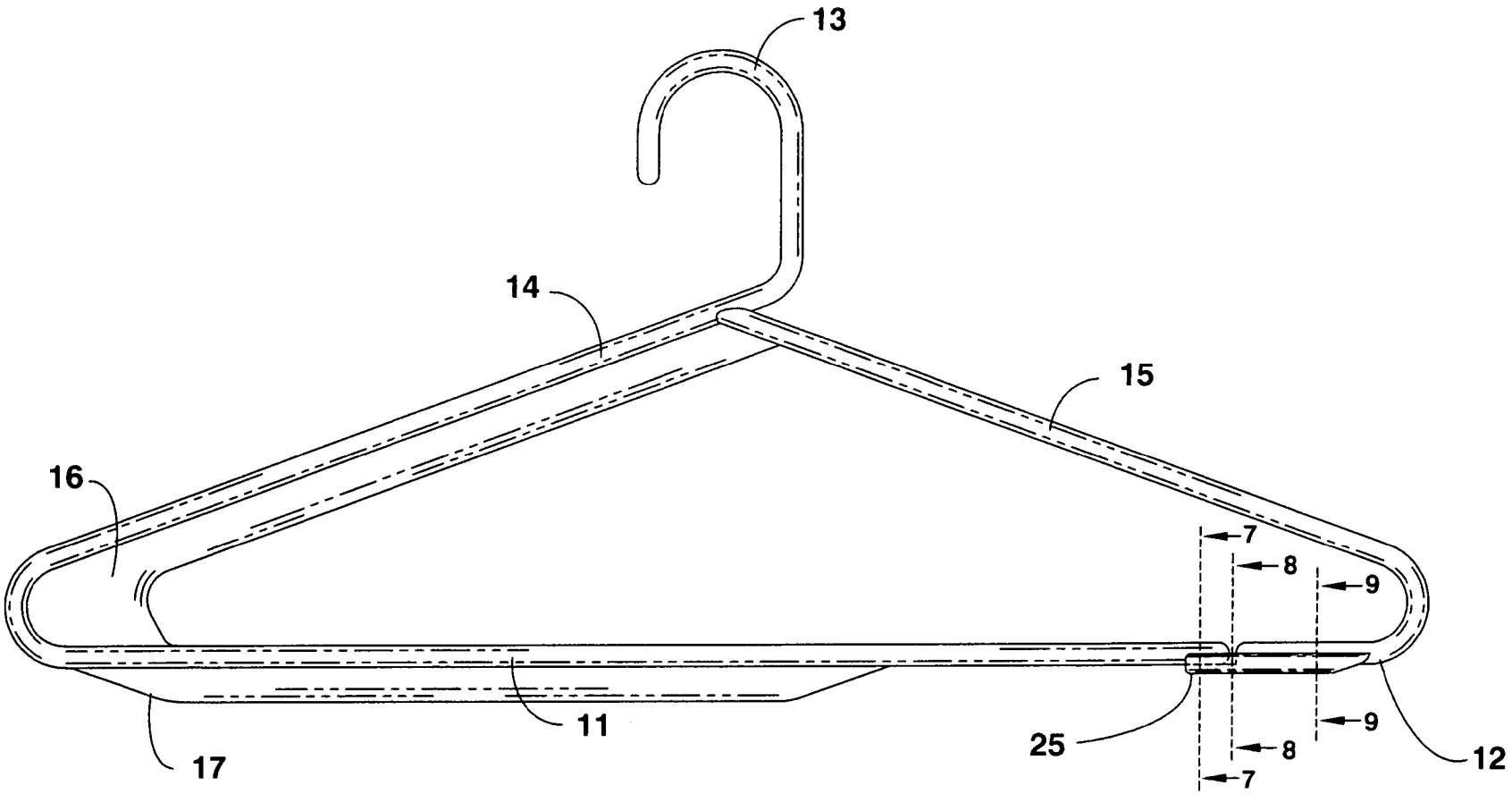
FIG. 6 is a front elevational view of a further preferred embodiment of the present invention.
Figure 10:
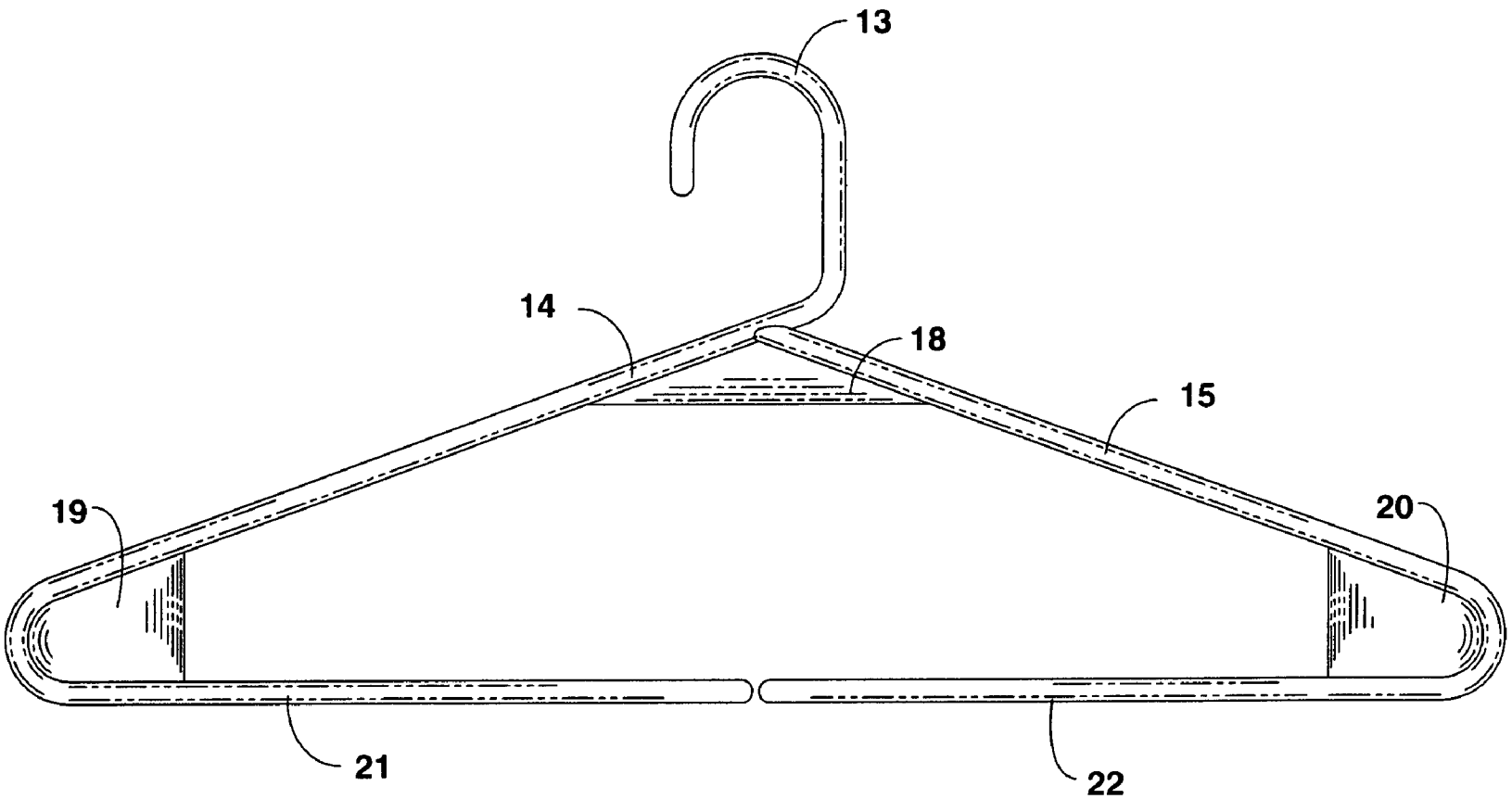
FIG. 10 is a front elevational view of a yet further preferred embodiment of the present invention.

In one aspect of a best mode embodiment of the present invention a clothes-hanging apparatus comprises a wire 10 formed into an upwardly extending support element such as hook 13 contiguous with a downwardly extending pair of sloping shoulders 14 and 15, the shoulders each contiguous with one of a pair of separate collinear horizontal legs 11 and 12 as shown in FIGS. 1 and 6, or legs 21 and 22 shown in FIG. 10. The term "wire" is used herein to define the shape of the material of which the present invention is made. Clothes hangers, including the present invention, are traditionally made of a long piece of wire, usually of metal or of plastic with any cross-sectional shape desired and are made typically by drawing metal or molding plastic. The horizontal legs 11, 12 or 21, 22 terminate, preferably, in an adjacent, non-abutting relationship as is shown in FIGS. 1, 6 and 10.

In order to produce the present invention in the most practical and economic manner, the size of the wire used is relatively small and might not support some relatively heavy garments such as overcoats and the like. Therefore, the present invention employs strengthening webs of relatively thin walled construction between parts of the apparatus. As shown in FIG. 10 a first strengthening web 19 and 20 are formed between the shoulders 14 and 15 and their contiguous horizontal legs 21 and 22 respectively. A second strengthening web 18 is formed between the shoulders 14, 15. These webs 18, 19 and 20 enable the apparatus to have a necessary overall strength, yet be made from a minimum of material. Webs 19 and 20 allow the legs 21 and 22 to have enough rigidity as to support a garment on the legs 21 and 22 yet to have enough flexibility as to be able to move the legs 21, 22 apart for inserting a garment between them rather than threading the garment into the apparatus. Therefore, the apparatus provides for improved convenience of placing and removing garments therewith.

Figures 1A, 1B:
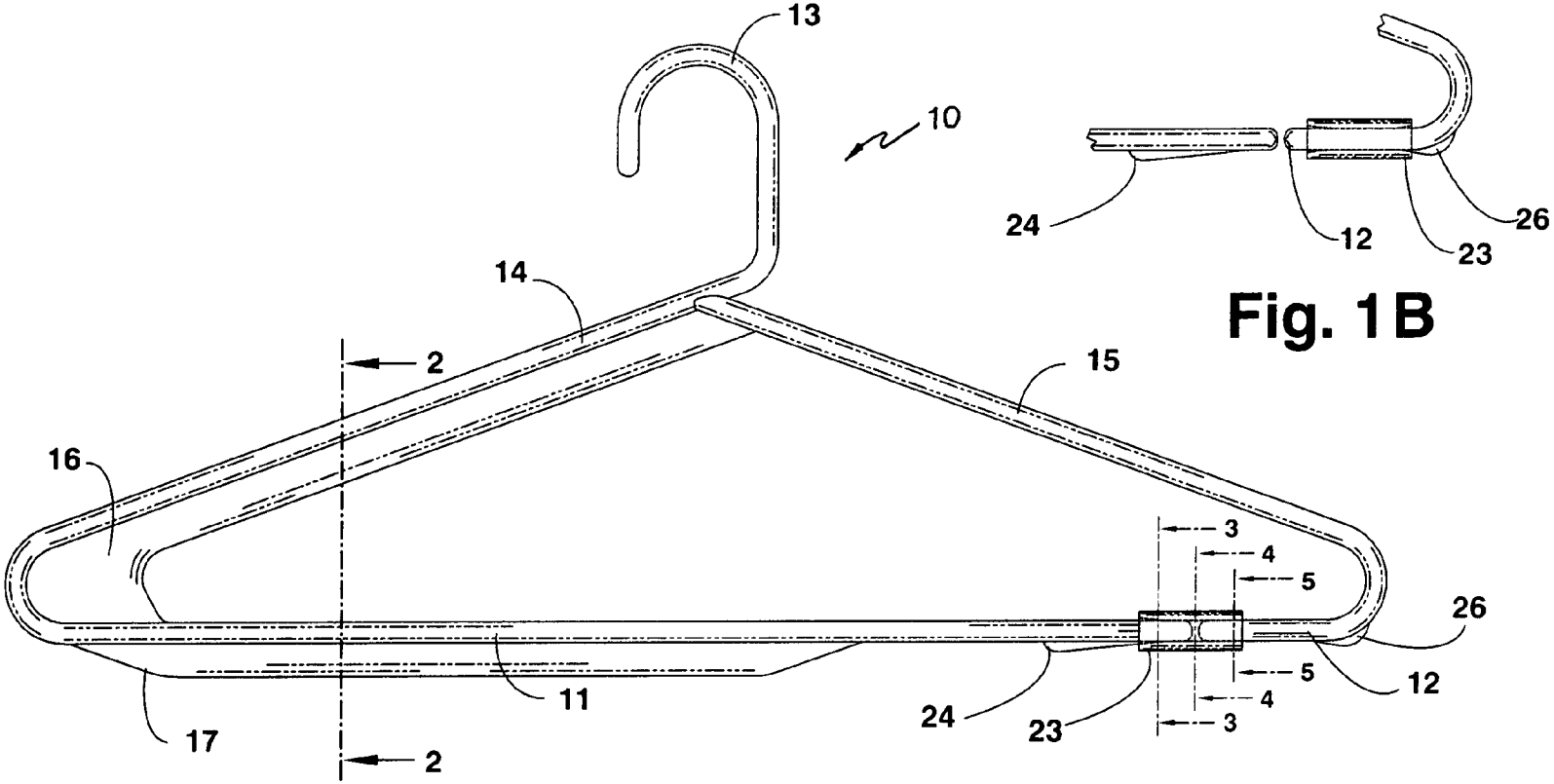
FIG. 1A is a front elevational view of a preferred embodiment of the present invention showing a closure tube in a locked position.
FIG. 1B is a partial view of FIG. 1A showing the closure tube in a released position.
Figure 5:
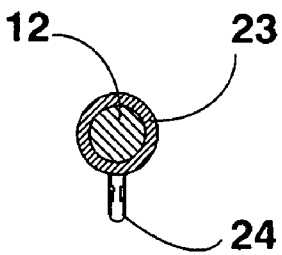
FIGS. 3-5 are sectional views taken along lines 3-3, 4-4 and 5-5 respectively in FIG. 1.
Figure 4:
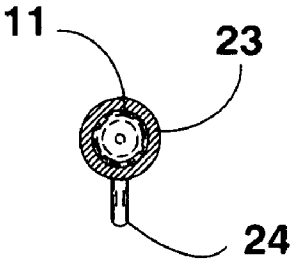
Figure 3:
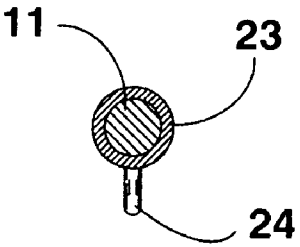

In the alternate embodiment shown in FIG. 1A, the apparatus preferably includes a closure tube 23 slidably engaged with the horizontal legs 11 and 12 and movable between a position for engaging both of the horizontal legs in rigidizing support thereof, as shown, and an alternate position on leg 12 of the pair of legs for freeing the legs to move out of collinear alignment, as shown in FIG. 1B. In this embodiment, a third strengthening web 17 is engaged axially with one 11 of the pair of legs for rigidizing thereof. Also, a fourth strengthening web 16 may be engaged between at least one of the pair of legs 11 and at least one of the sloping shoulders 14 for rigidizing thereof. The arrangement shown in FIG. 1A is preferred, but not considered the only manner in which the apparatus may be rigidized and adapted for use. It is noted that the web 17 is of a size and position to allow the leg 11 to flex and move laterally, but to not flex vertically. This enablement prevents the leg 11 from drooping under the weight of a garment that may be laid thereon. In use, the leg 11 is moved laterally and a garment (not shown) is place thereon, the leg 11 is then moved into collinear alignment with leg 12 and locked in place as shown in FIG. 1A wherein fifth and sixth webs 24 and 26 are shown engaged with the pair of legs 11 and 12 respectively, and the closure tube 23 is shown engaging web 24 wherein the tube 23 locks the legs 11 and 12 together. Alternately, as shown in FIG. 1B, the closure tube 23 is shown moved to the right to engage web 26 for unlocking the legs 11 and 12. The closure tube 23 is captured respectively by either web 24 or web 26 by jamming the closure tube 23 against these webs so that it is temporarily captured by frictional engagement and it stays in place and will not fall from the apparatus during garment movement.

Figure 9:
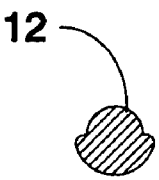
FIGS. 7-9 are sectional views taken along lines 7-7, 8-8 and 9-9 respectively in FIG. 6.
Figure 8:
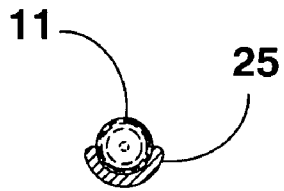
Figure 7:
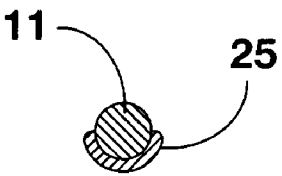
Figure 2:
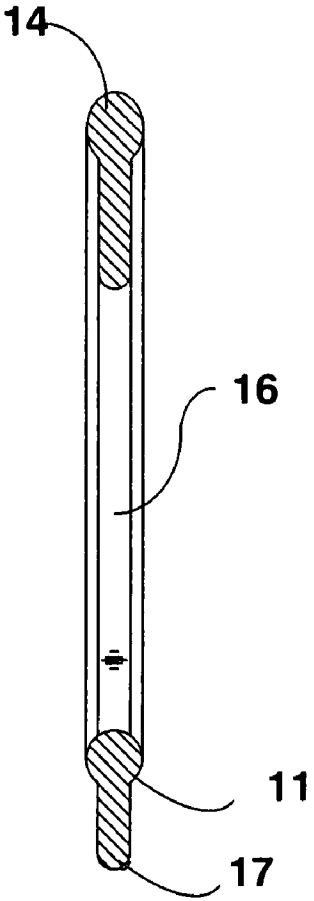
FIG. 2 is a sectional view taken along line 2-2 in FIG. 1.

In FIG. 6 an arcuate rest piece 25 is shown as integral with one 12 of the pair of legs, the rest piece 25 protruding axially away from the leg 12 in a position for supporting the other 11 of the pair of legs. See sectional FIG. 9 for an understanding of how the rest piece 25 is made integral with the one 12 of the pair of legs.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A clothes-hanging apparatus comprising: a wire having an upwardly extending support element and downwardly depending therefrom, a pair of sloping shoulders contiguous therewith, the shoulders terminating in a pair of collinearly aligned, adjacent, horizontal legs; a first strengthening web joined with both one of the shoulders and one of the horizontal legs, and a second strengthening web extending along one of the pair of horizontal legs and depending downwardly therefrom.

2. The apparatus of claim 1 wherein the first strengthening web extends between each of the shoulders and the contiguous horizontal legs thereof.

3. The apparatus of claim 1 further comprising a closure tube slidably engaged with the horizontal legs and movable into a position joining both of the horizontal legs, and further movable into a position engaging only one of the pair of legs whereby the legs are enabled for moving out of collinear alignment.

4. The apparatus of claim 3 further comprising at least one still further web positioned for engaging the closure tube alternately in the engaging position and the joining position.

5. The apparatus of claim 1 further comprising an arcuate rest piece integral with one of the pair of legs in a position below the one of the pair of legs, the rest piece protruding axially away from the one of the pair of legs in a position for supporting the other of the pair of legs when the other of the pair of legs is rested in the arcuate rest piece.

* * * * *